US009126322B2

(12) United States Patent
Yaschur et al.

(10) Patent No.: US 9,126,322 B2
(45) Date of Patent: Sep. 8, 2015

(54) POWER TOOLS WITH AN INTERNAL METAL HOUSING ATTACHED TO AN OUTER COMPOSITE SLEEVE

(71) Applicant: Ingersoll-Rand Company, Davidson, NC (US)

(72) Inventors: Jefferey Clifford Yaschur, Doylestown, PA (US); Randi Jane Young, Randolph, NJ (US); Douglas Eliot Pyles, Bethlehem, PA (US)

(73) Assignee: Ingersoll-Rand Company, Davidson, NC (US)

( * ) Notice: Subject to any disclaimer, the term of this patent is extended or adjusted under 35 U.S.C. 154(b) by 239 days.

(21) Appl. No.: 13/798,794

(22) Filed: Mar. 13, 2013

(65) Prior Publication Data

US 2013/0316626 A1 Nov. 28, 2013

Related U.S. Application Data

(60) Provisional application No. 61/651,654, filed on May 25, 2012.

(51) Int. Cl.

| | |
|---|---|
| ***B24B 23/00*** | (2006.01) |
| ***B25F 5/02*** | (2006.01) |
| ***B24B 41/00*** | (2006.01) |
| ***B24B 23/02*** | (2006.01) |

(52) U.S. Cl.
CPC . *B25F 5/02* (2013.01); *B24B 23/00* (2013.01); *B24B 23/026* (2013.01); *B24B 41/00* (2013.01); *Y10T 29/49826* (2015.01)

(58) Field of Classification Search
CPC ..... B24B 23/00; B24B 41/00; B25F 5/007; B25F 5/02
USPC ..... 451/359, 344, 294, 295, 449
See application file for complete search history.

(56) References Cited

U.S. PATENT DOCUMENTS 3,809,179 A * 5/1974 Delaney et al. ..... 181/230
4,380,270 A * 4/1983 Ludwig ..... 173/221

(Continued)

FOREIGN PATENT DOCUMENTS

EP 2080588 7/2009

OTHER PUBLICATIONS

Industrial Surface Preparation, Product Listing and Description, Ingersoll Rand Industrial Technologies, © 2010 Ingersoll-Rand Company Limited, 63 pages.

(Continued)

*Primary Examiner* — Robert Rose
(74) *Attorney, Agent, or Firm* — Sunstone IP

(57) ABSTRACT

Hand-held power tools with an external composite sleeve having a forward portion and a rearward portion and defining an axially extending cavity. The power tools also include an internal metal housing having a substantially cylindrical body with a plurality of circumferentially spaced apart, longitudinally-extending front posts that project radially outward from the cylindrical body. The metal housing resides in the composite sleeve. The front posts can be closely spaced to or abut an inner surface of the forward end (e.g., front cap) of the sleeve. In a front exhaust configuration, the front posts and sleeve cooperate to define a plurality of circumferentially spaced apart gap spaces, a respective gap space bounded by adjacent posts, an outer surface of the cylindrical body and the inner surface of the sleeve.

19 Claims, 16 Drawing Sheets

(56) References Cited

U.S. PATENT DOCUMENTS

| | | | | |
|---|---|---|---|---|
| 5,383,771 | A * | 1/1995 | Ghode et al. | 418/15 |
| 5,591,070 | A * | 1/1997 | Kachich | 451/295 |
| 5,609,515 | A | 3/1997 | Takach | |
| 5,775,981 | A * | 7/1998 | Yang | 451/295 |
| 6,264,408 | B1 * | 7/2001 | Lung et al. | 409/182 |
| 7,207,394 | B2 | 4/2007 | Young | |
| 2007/0102179 | A1 | 5/2007 | Young et al. | |
| 2011/0092140 | A1 | 4/2011 | Li | |

OTHER PUBLICATIONS

G Series Industrial Grinders, Product Listing and Description, Ingersoll Rand-Company, © 2007, 6 pages.

International Search Report and Written Opinion for corresponding PCT Application No. PCT/US2013/040046, date of mailing Sep. 17, 2013.

International Preliminary Report on Patentability dated Nov. 25, 2014 from International Patent Application No. PCT/US2013/040046 filed May 8, 2013.

* cited by examiner

POWER TOOLS WITH AN INTERNAL METAL HOUSING ATTACHED TO AN OUTER COMPOSITE SLEEVE

RELATED APPLICATIONS

This application claims the benefit of and priority to U.S. Provisional Application Ser. No. 61/651,654, filed May 25, 2012, the contents of which are hereby incorporated by reference as if recited in full herein.

FIELD OF THE INVENTION

This invention relates to hand-held power tools and is particularly suitable for industrial grinders and sanders.

BACKGROUND OF THE INVENTION

Industrial hand-held power tools can be light weight for ease of use but can be subjected to relatively harsh operating environments. For example, it is desirable to size grinders and sanders in user-friendly sizes and with sufficient air flow to support target performance criteria. The tools should also be sufficiently durable to withstand the rigors of power and target output performance for demanding industrial environments.

SUMMARY OF EMBODIMENTS OF THE INVENTION

Embodiments of the invention are directed to light-weight, hand-held power tools and may be particularly suitable for grinders and/or sanders.

Embodiments of the invention are directed to hand-held power tools. The tools include an external composite sleeve having a forward portion and a rearward portion and defining an axially extending cavity and an internal metal housing having a substantially cylindrical body with a plurality of circumferentially spaced apart, longitudinally-extending, front metal posts that project radially outward a distance from the cylindrical body. The metal housing resides in the composite sleeve.

The front posts can be externally visible to a user.

The front posts can have a free outer end that reside adjacent an inner surface of a forward end (e.g., front cap) of the sleeve.

The tool can be a front exhaust tool. The front posts and front end (e.g., front cap) of the sleeve can cooperate to define a plurality of circumferentially spaced apart gap spaces, a respective gap space bounded by adjacent front posts, an outer surface of the cylindrical body and an inner surface of the sleeve to define front exhaust paths for the power tool.

The tool can be a rear exhaust tool. The sleeve can have a front edge with a curvilinear perimeter profile that faces the internal housing and has a circumferentially repeating pattern of an arc segment that transitions to a groove segment.

The tool can include a cylinder with a vane motor that resides in the cavity of the internal housing a distance rearward of the front posts. The sleeve can include a front cap with a plurality of circumferentially spaced apart, longitudinally extending ribs on an inner surface thereof that matably engage longitudinally extending ribs on an external surface of the cylindrical body of the internal housing. The housing ribs can reside a distance behind the front posts.

The tool can include threads on an inner surface of the internal housing that threadably engage a clamp member on a forward end portion of the tool, the clamp member sized and configured to provide an externally accessible flat clamping surface.

The sleeve can include three discrete components, a front cap, a rear cap and a substantially cylindrical elongate center grip portion. The rear cap can include a plurality of circumferentially spaced apart composite rear posts that radially extend about an open center aperture.

The tool can be a rear exhaust tool. The sleeve can include front cap, a rear cap, and an elongate center grip portion. The rear cap can include a plurality of radially extending, circumferentially spaced apart composite rear posts that have gap spaces therebetween to define air exhaust ports. The front cap can have a configuration that encases the front end portion of the internal housing and closes gap spaces between the front posts.

The tool can be horizontal grinder or sander. The rear cap can have an open center space bounded by a circular segment that merges into the radially extending rear posts. An outer end of the rear posts can merge into an outer circular segment that is larger than the inner circular segment.

The sleeve can include a front cap and a substantially cylindrical elongate grip portion. The front cap can have a substantially constant diameter or a tapered outer profile with a front end thereof that merges into a thicker rearwardly extending portion with an inner surface segment that extends radially inward a stepped distance and defines a muffling surface stop, then tapers inward to a thinner portion that resides under a leading edge of the center grip portion.

The sleeve can include a front cap that engages a substantially cylindrical elongate grip portion. A forward edge portion of the cap can reside proximate to or abut the front posts and defines air exhaust ports over the gap spaces. The tool can include a vane motor residing in a cavity of the internal metal housing. The internal housing can have a plurality of circumferentially spaced apart air passages on a forward end portion thereof that allow air from the cylinder to travel to an annular exhaust chamber residing behind the posts, the annular exhaust air chamber defined by an outer wall of the internal housing and an inner wall of the front end cap.

The plurality of front posts can be at least five.

The posts can have a width dimension about the same or greater than a radially extending height dimension.

The internal housing can have at least two sets of circumferentially spaced apart longitudinally extending ribs on an outer surface thereof, that reside behind the front posts.

The plurality of front posts is five and the front posts are equally circumferentially spaced-apart. The front posts can be tapered, with narrower ends facing the sleeve.

The internal metal housing can be aluminum or magnesium and can encase an air vane pneumatic motor. The composite sleeve can have an elongate center grip portion, a front cap abuts a front end of the center grip portion and a rear cap abuts a rear end of the center grip portion. The center grip portion can be used for both front and rear air exhaust power tool configurations. For a front exhaust configuration, the front cap can be configured to only contact or reside adjacent to the front posts and allow the gap spaces to define pressurized air exhaust paths. For the rear air exhaust configuration, the front cap can be configured with inwardly extending segments that close the gap spaces.

The rear cap can have a plurality of radially extending composite posts that are circumferentially spaced apart and have a substantially similar configuration as the front posts. The front cap can have a plurality of flat anti-rotation surfaces on an exterior thereof.

Other embodiments are directed to internal housings for a hand-held industrial power tools. The housings include a metal housing having a substantially cylindrical body with opposing forward and rear ends and a plurality of circumferentially spaced apart, longitudinally-extending, front posts on the forward end of the cylindrical body that project radially outward a distance from the cylindrical body (typically between about 0.125 inches to about 0.5 inch). The internal metal housing also include a plurality of longitudinally extending ribs that reside a distance spaced apart from and behind the front posts on a forward portion thereof and a plurality of circumferentially spaced apart air exhaust passages that extend radially outward from an inner surface to an outer surface of the metal housing behind the front posts on a forward end portion of the cylindrical body of the metal housing.

The plurality of front posts can be five front posts that are tapered with a more narrow end being a free end that, in operative position, are adapted to face a composite sleeve.

Yet other embodiments are directed to methods of assembling a hand-held power tool. The methods include: (a) providing a substantially cylindrical metal housing having opposing front and rear ends, wherein the front end comprises a plurality of circumferentially spaced apart, longitudinally-extending front posts with free ends that project radially outward from the cylindrical body in a direction that is substantially orthogonal to a long axis of the cylindrical metal housing; (b) providing a composite outer sleeve as three components including a front cap, end cap and center grip portion; and (c) assembling the outer sleeve to the metal housing so the metal housing resides in the composite sleeve with the free ends of front posts residing proximate an inner surface of the front cap of the sleeve.

The plurality of front posts can be five. The five posts can be equally spaced-apart posts. The front posts can be tapered, with narrower ends facing the sleeve.

The assembling step can optionally include selecting either a first set of front and rear end caps to the center grip portion for a front air exhaust configuration or a second set of front and rear end caps to the center grip for a rear air exhaust configuration. The front cap of the second set of caps can close off gap spaces between the front posts while the front cap in the first set of caps can cooperate with the posts and housing to define front air exhaust pressurized ports for the power tool.

The metal housing can have at least two pair of circumferentially spaced apart alignment ribs on an exterior surface thereof that extend rear of the front posts. The sleeve front cap can have matable ribs. The assembly step can include aligning the ribs and sliding the front cap onto the housing and defining annular exhaust chambers between an outer surface of the housing and an inner surface of the front cap adjacent to but behind the front posts.

The foregoing and other objects and aspects of the present invention are explained in detail in the specification set forth below.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DESCRIPTION OF EMBODIMENTS OF THE INVENTION

Figure 1:
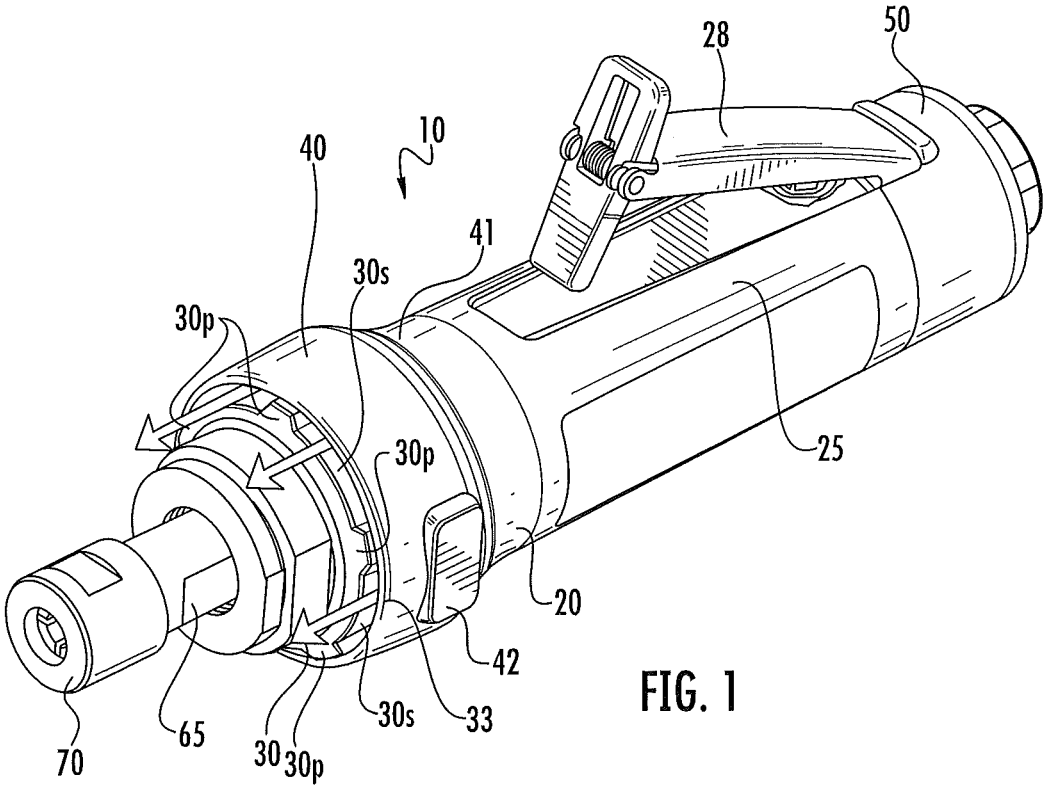
FIG. 1 is a side perspective view of an exemplary power tool according to embodiments of the present invention.
Figure 3:
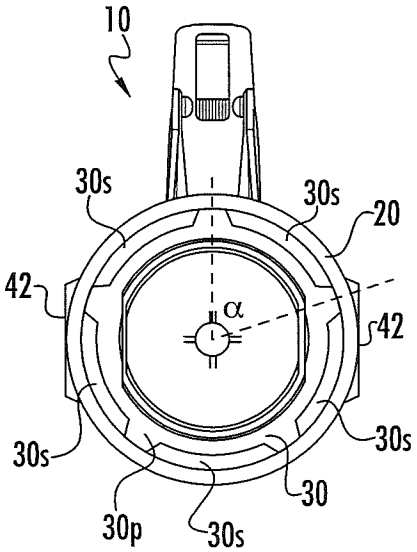
FIG. 3 is a front end view of the tool shown in FIG. 1.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. In the drawings, the thickness of lines, layers, features, components and/or regions may be exaggerated for clarity and broken lines illustrate optional features or operations, unless specified otherwise.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "comprises," "comprising," "includes," and/or "including" when used in this specification, specify the presence of stated features, regions, steps, operations, elements, and/or components, but do not preclude the presence or addition of one or more other features, regions, steps, operations, elements, components, and/or groups thereof.

It will be understood that when a feature, such as a layer, region or substrate, is referred to as being "on" another feature or element, it can be directly on the other feature or element or intervening features and/or elements may also be present. In contrast, when an element is referred to as being "directly on" another feature or element, there are no intervening elements present. It will also be understood that, when a feature or element is referred to as being "connected", "attached" or "coupled" to another feature or element, it can be directly connected, attached or coupled to the other element or intervening elements may be present. In contrast, when a feature or element is referred to as being "directly connected", "directly attached" or "directly coupled" to another element, there are no intervening elements present. Although described or shown with respect to one embodiment, the features so described or shown can apply to other embodiments.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein.

The term "hand-held" refers to power tools that are sufficiently light weight to allow for a user to hold the device. Examples of different power tools include, grinders, sanders, screwdrivers, ratchets, nutrunners, impacts, drills, drill drivers, grease guns and the like.

The term "composite" refers to materials in which a homogeneous matrix component is reinforced by one or more stronger and stiffer constituents that includes a usually fibrous constituent, but may have a particulate or other constituent shape. The composite material can include at least one polymer, copolymer or derivates thereof. The constituent can be or include glass fibers. The word "about" for dimensions means that the size can vary by +/−10% and for operational outputs such as RPM, force, weight or torque and the like means the parameter can vary by +/−20%.

Embodiments of the invention may be particularly suitable for pneumatic operated power tools such as grinders and sanders. The pneumatic operated power tool may be lightweight, such as about 5 pounds or less, typically about 4 pounds or less. The tool can, in some embodiments, operate with a maximum rated standard cubic feet per minute (scfm) output that is between about 19-90 scfm. The maximum rated horsepower (hp) can be between about 0.4 to about 2, typically about 0.5 hp, about 1.0 hp and about 1.8 hp, depending on the particular tool model. The free speed RPM (no load) can be between about 7000-35,000, depending on particular tool features, such as, for example, whether rear or front exhaust, tool configuration (grinder or sander), angle, horizontal or straight-extended configurations, air input and air motor. However, other scfm, hp and free speed RPM can be used.

Referring now to FIGS. 1-4, 6 and 8, the power tool 10, 10' includes an outer composite sleeve 20 that contacts an internal metal housing 30. The internal housing 30 is typically a die cast housing. The internal metal housing 30 be or comprise aluminum, magnesium or other suitable material. The composite sleeve 20 can form the outside surface of the tool 10, 10' (FIG. 8) directing airflow from the motor 60 away from the operator. As shown, the internal housing 30 includes a plurality of circumferentially spaced apart, longitudinally extending front posts 30*p* that project radially outward and reside proximate to and may abut or contact the sleeve 20 and can be externally visible to a user. The front posts 30*p* can be oriented to reside substantially orthogonal to the axial centerline (long axis) of the housing 30 and/or cylinder 60*c*. This structure combines the strength of an internal metal housing 30 with the resilience of the outer composite sleeve 20.

In front exhaust versions, e.g., FIGS. 1-4, 6 and 7, the outer surface of the cylindrical body of the housing 30, the housing posts 30*p* and composite sleeve 20 (e.g., front cap 40 of the sleeve 20) define gap spaces 30*s* that define exhaust ports 33 for a front exhaust tool 10. This configuration particularly suitable for industrial hand-held power tools including grinders (die grinders and angle grinders) and sanders. As is known to those of skill in the art, the tool 10 can include an inlet bushing (typically steel), a ball valve (that can have a brass valve seat), a spring a filter screen and a pin assembly (that cooperates with the lever 28).

FIGS. 8-12, and 13 illustrate the tool 10' with a rear exhaust configuration according to some embodiments of the present invention. In this embodiment, the sleeve 20 (e.g., the front cap 40' of the sleeve 20) defines a closed perimeter interface for the internal housing posts 30*p* rather than open exhaust ports as shown with respect to FIG. 1 as will be discussed further below.

Figure 4:
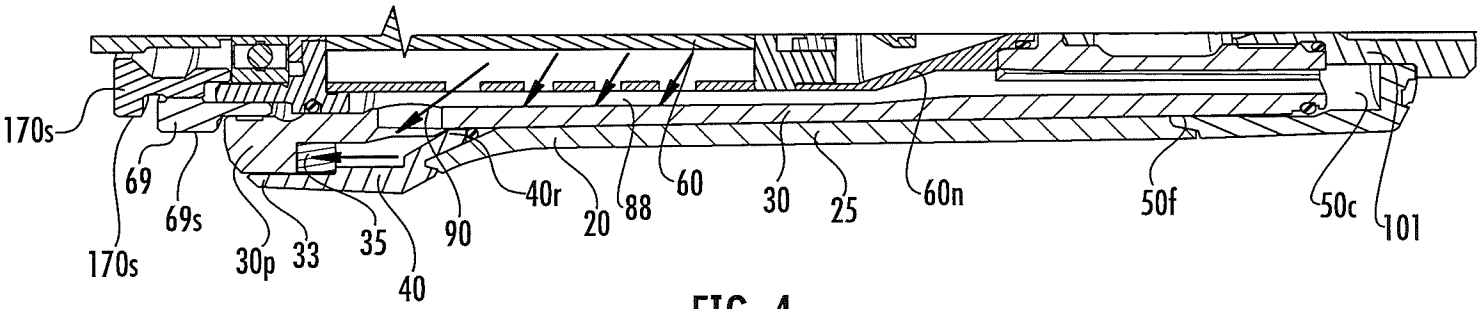
FIG. 4 is a section view of a portion of the tool shown in FIG. 1, rotated to illustrate housing exhaust holes according to embodiments of the present invention.

The tool 10, 10' includes a pneumatic motor 60 that resides in a cylinder 60*c* in the internal metal housing 30 and that communicates with pressurized air 100 (FIG. 4). The motor 60 can power a collet nut 65 with a coupler 70 (that can be interchanged to hold different tools, gears, hex couplers or other components) as is well known. The pneumatic motor 60 can be a vane motor as is also well known. The tool 10 can be configured to have a motor assembly 60*a* (FIG. 5).

Figure 5:
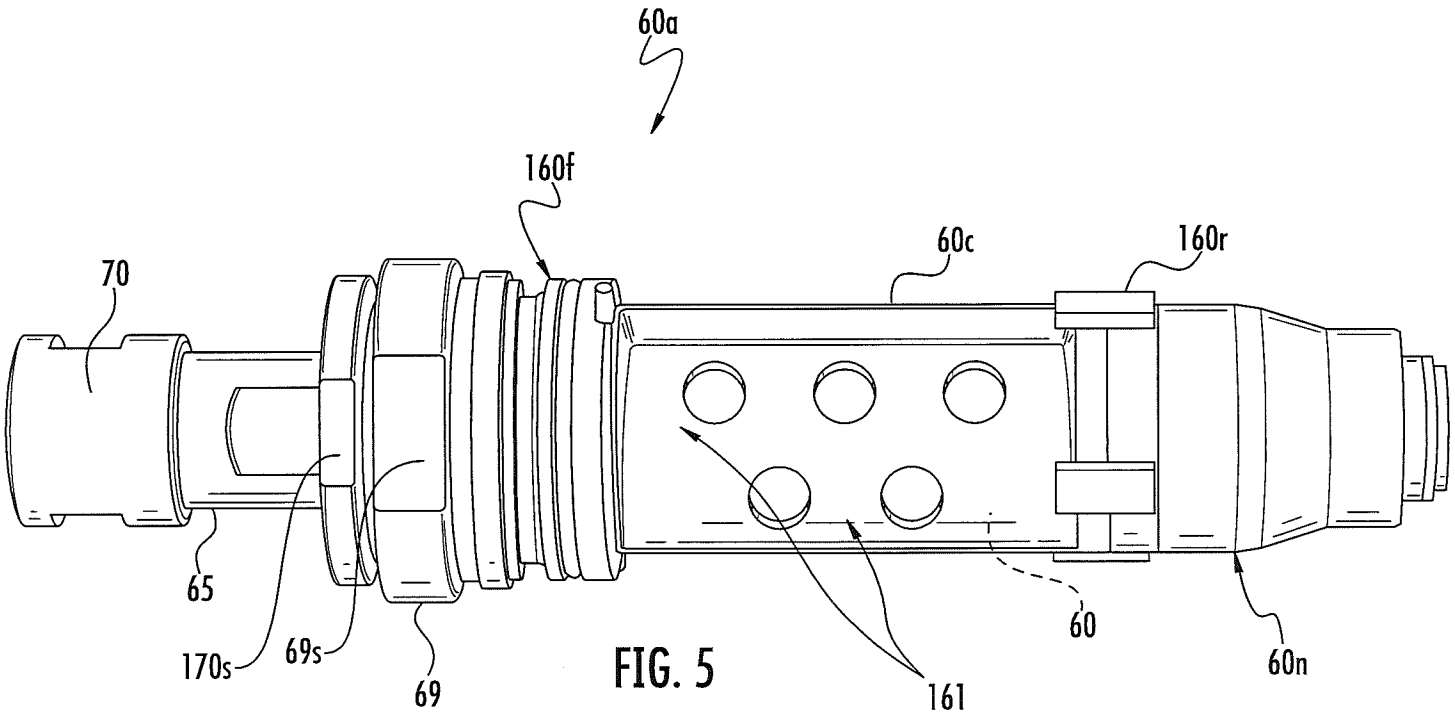
FIG. 5 is a side perspective view of an exemplary motor assembly according to embodiments of the present invention.

FIG. 5 illustrates an example of a motor assembly 60*a* that includes the motor 60, the cylinder 60*c*, the collet nut 65, the coupler 70, front and rear end plates 160*f*, 160*r*, respectively, and nozzle 60*n*. The assembly 60*a* can be inserted and withdrawn from the housing 30 as a single assembly. The cylinder 60*c* includes exhaust holes 161 that can have any shape and can be distributed over the cylinder.

As shown in FIG. 4, the front end portion of the housing 30 can include internal threads 30*t* that can threadably engage a clamp member 69. The clamp member 69 provides a flat clamp surface 69*s* and can be threadably attached to a coupling member 170. The coupling member 170 may also include a flat clamp surface 170*s*. To disassemble the motor (and controller) assembly 60*a* from the housing 30, a vice clamp can be applied to the clamp surface 170*s*. The clamp member 69 can be turned to uncouple the motor assembly 60*a* from the housing 30, allowing a user to pull out the motor assembly. The reverse steps can be used to assemble the tool 10, 10'.

In some embodiments, as also shown in FIG. 4, the back side of the front posts 30*p* can be configured as a mechanical stop that resides against muffling material 35 inside the housing 30. The muffling material 35 can comprise any shock reducing or insulating material. The muffling material 35 can be provided as a unitary ring of material or may be provided as discrete pieces of material. For rear exhaust versions of the tool 10', the front muffling 35 can be omitted and a rear muffling can be used.

Figure 2:
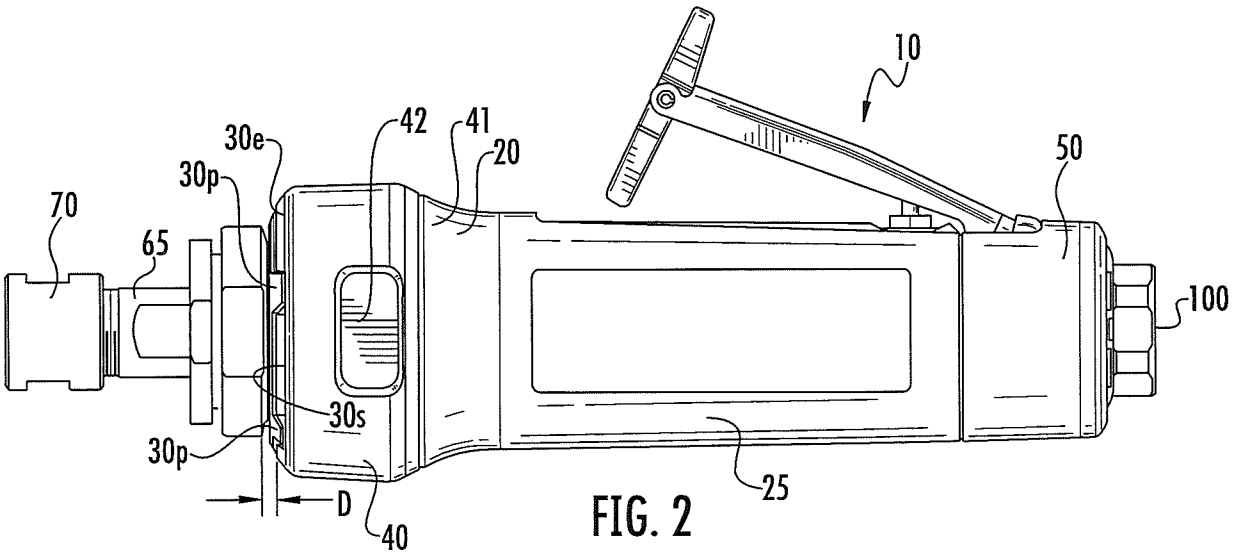
FIG. 2 is a side view of the tool shown in FIG. 1.

As shown in FIGS. 1 and 2, the air exhaust port configuration 33 is a front exhaust configuration provided by the spaces 30*s* between the posts 30*p* and the outer sleeve 20. The geometry and spacing of the posts 30*p* can be designed to provide a balance between strength and airflow, particularly when used for the front exhaust tool configuration. Upon the event of an impact, the composite sleeve 20 may (resiliently) deform and/or absorb shock, helping minimize the damage to the tool. The ergonomic aesthetic design is scalable and can be applied to a variety of tools.

The front posts 30*p* can have a longitudinal length of between about 0.1 inches to about 1 inch, typically between about 0.125-0.5 inches. The posts 30*p* can have a width dimension that is about the same or greater than a radially extending height dimension.

The shape of the posts 30*p* can be externally visible to a user. The term "externally visible" means that the post shapes are visible to a user in the configuration shown in the drawings, recognizing that certain end components added to the tool may occlude the view. Also, the post surfaces may include paint, film or other coatings but the post shapes can still be visible.

In some particular embodiments, the posts 30*p* can have a radially extending length of between about 0.1-0.5 inches, typically about 0.125-0.5 inches. The posts 30*p* can have a slightly curved front surface contour or profile (that faces the output tool coupler 70). The front edge of the internal housing 30*e* can be visible by a user (it extends close to or outside the sleeve 20). Indeed, the front edge 30*e* can reside a very short distance "D" axially outside or beyond the sleeve 20, such as between about 0.01 inches to about 0.25 inches, as shown in FIGS. 2 and 4, for example. The front edge of the sleeve (e.g., front cap edge 40*e*) can have a short frustoconical shape, such as a beveled 30 degree angled contour, in the axial direction. However, in other embodiments, the internal housing 30 can be flush or recessed inside the sleeve 20.

Figure 8:
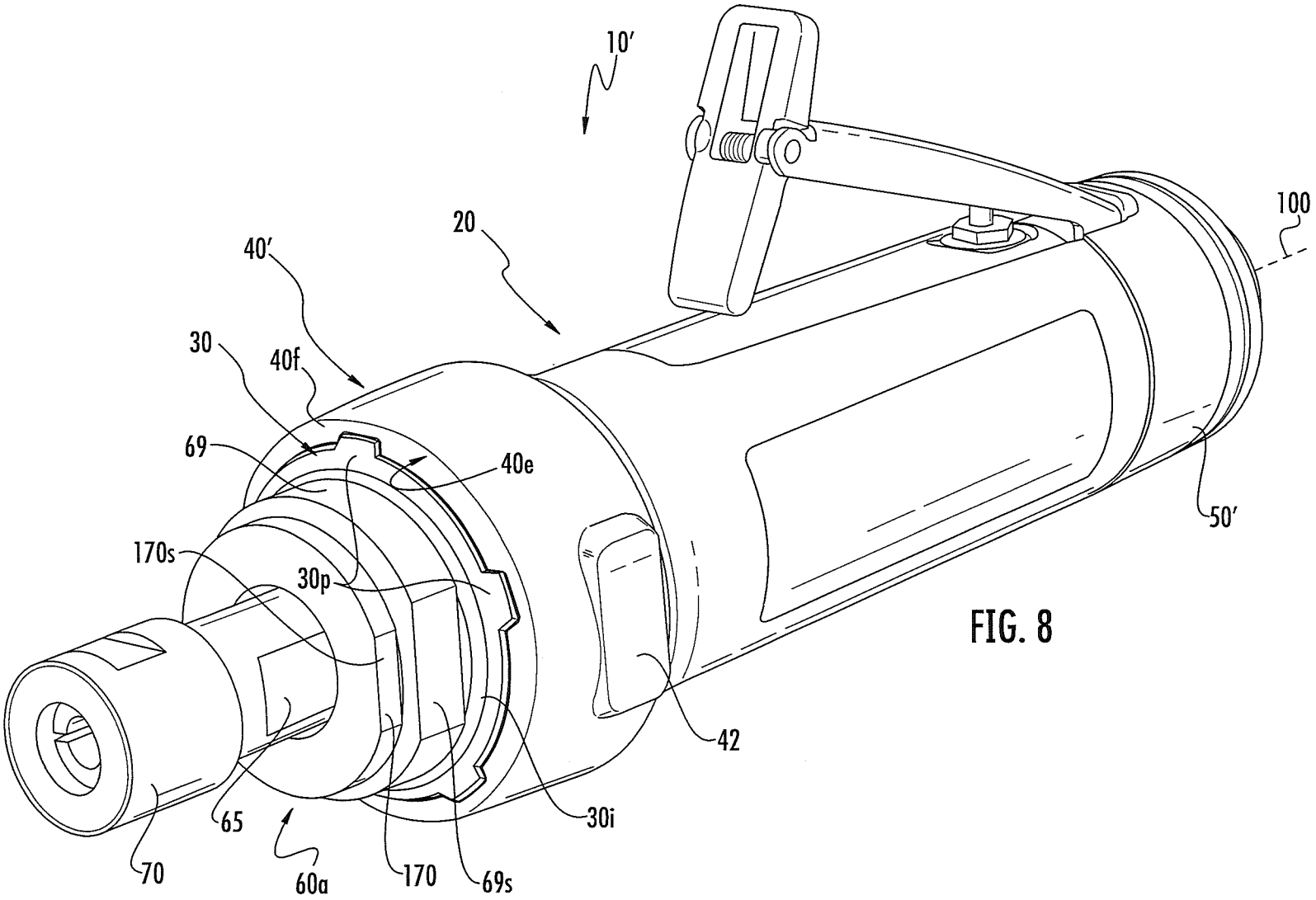
FIG. 8 is a side perspective view of another embodiment of a tool according to embodiments of the present invention.
Figure 11:
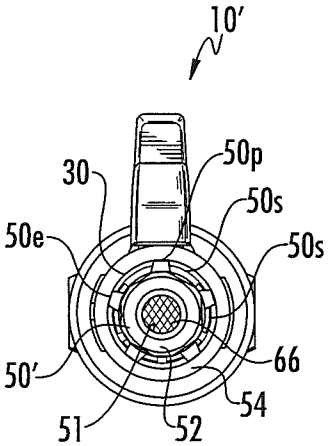
FIG. 11 is a rear end view of the tool shown in FIG. 8.

As shown in FIGS. 1 and 8, the (metal) front posts 30*p* (and composite rear posts 50*p* provided by the end cap 50, 50', where used, FIGS. 6, 11) can be provided as five tapered posts, with the narrow end facing out toward the composite sleeve 20, giving a truncated star-like and/or pentagonal shape of five radiating segments. However, other shapes and numbers of posts 30*p* may be used while still providing sufficient structural support and sufficient airflow. For example, the five front posts 30*p* can be straight, non-tapered posts, or may be tapered in the reverse direction or tapered along one long side. Alternately, the posts 30*p*, 50*p* can be provided as four larger posts or more than five posts, such as, for example, about six-ten posts 30*p*. Each post 30*p*, 50*p* can have the same shape and size or different posts can have different shapes or sizes. As shown, the posts 30*p*, 50*p* are five symmetrically arranged posts with adjacent centerlines at an angle "α" of about 72 degrees apart.

In operation, more exhaust air may exit some of the spaces 30*s* than others, e.g., two of five (where five are used) may exhaust a greater amount of air.

The sleeve 20 can comprise a relatively thin composite material. The term "thin" refers to composite material having a thickness less than about 4 mm thick, typically between about 1.5-3 mm thick, on average. The composite material can be between 20-70% glass fiber filled nylon, typically about 30-35% glass filled nylon. The composite material may include other constituents or materials.

The center grip portion of the sleeve 25 can abut front and rear end caps 40, 40'; 50, 50'. The operating handle 28 can actuate up and down to control tool speed as is well known. Other types of triggers or handles may be used.

As shown in FIGS. 1 and 2, for example, the grip 25 has a center portion and rear portion that have an integrated form and can be slightly conical in shape. The center grip portion 25 can have a round cross-section (FIG. 3) that can reduce grip circumference and provide improved ergonomics. The front portion of the center grip 25 can flare to a ridge 41 which can provide a tactile cue/feel to a user, denoting the forward edge of proper grip hand placement.

The tool 10, 10' can have at least one substantially flat outwardly projecting pad 42 that extends out a distance from the contour of the outer sleeve. Typically, there are at least two diametrically opposed pads 42 (which may also act as flat rectangular clamping pads) incorporated opposite to each other, on the front cap 40. The pad(s) 42 can facilitate ease of servicing/maintenance or repair and/or can inhibit the tool 10, 10' from rolling when at rest.

The front cap 40 can have an internal ledge 43 that cooperates with a rear edge of the posts 30*p* to trap the muffling material 35 therebetween as shown in FIG. 4.

The rear edge 40*r* of the front cap 40, 40' can reside under a forward edge of the center grip portion 25, and the leading or forward edge of the rear cap 50, 50' can also reside under the rear edge of the grip surface, as also shown in FIG. 4. The front and rear caps 40, 50 and/or 40', 50' can be permanently or releasably attached to the center grip portion 25 and can be configured to provide a relatively seamless external interface junction at each attachment region. Also, the sleeve 20 may be formed as a unitary sleeve that incorporates either or both of the rear and front end caps (not shown). However, more typically, the sleeve 20 includes three components, e.g., front and rear caps 40, 50 and 40', 50' and the center grip 25 and are releasably engaged. The separate outer sleeve components can be slidably serially slid onto the housing 30 and pushed together (typically from the rear toward the forward end of the tool) to abut each other (but can release when pressure from the bushing 101 is removed).

The front cap 40, 40' can have a substantially constant outer diameter or may taper inward a distance over its length to slightly narrow in diameter from a rear to the front end portion by between about 2-3 mm. For example, the front cap 40, 40' can have a length of about 0.5-3 inches, typically about 1 inch, and the diameter can taper down in a forward direction by about 2-4 mm. In some particular embodiments, the diameter of the front end cap 40, 40' can be about 57.7 mm at a rear end thereof to about 49.7 mm at a front end thereof.

Referring again to FIG. 4, the housing 30 and external wall of the cylinder 60*c* can define an elongate pocket or free space 88 therebeween that extends over substantially an entire length of the cylinder 60*c* inside the housing 30 that accommodates an air volume of exhaust expelled or exhausted from the motor 60 during operation. A front portion of the tool can include a plurality of relatively large air passages 90 that fluidly connect the annular elongate volume 88 to an annular exhaust chamber that resides between the sleeve 20 and housing 30. In the front exhaust version shown in FIG. 4, exhaust air is then directed out through the post gap spaces 30*s*, typically first through the muffling material 35. The air passages 90 can be circumferentially spaced apart about the cylinder 60*c*. The air passages 90 can be four substantially equally, circumferentially spaced apart air passages in the housing 30. For rear exhaust versions, the exhaust air can be directed to exit through the rear end cap exhaust ports 50*s* (FIG. 11).

Figure 6B:
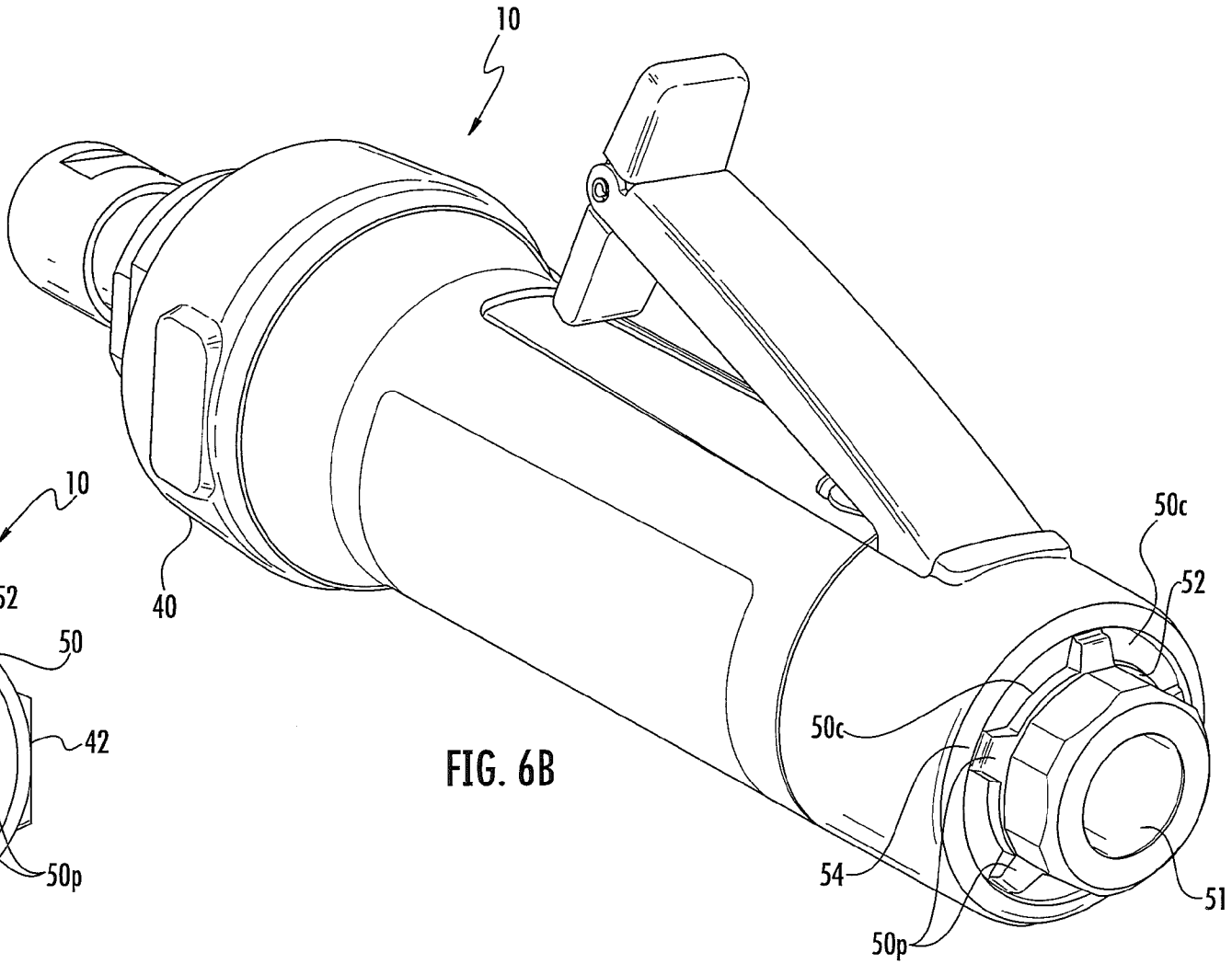
FIG. 6B is an enlarged rear, side perspective view of the tool shown in FIG. 1 according to some embodiments of the present invention.
Figure 6A:
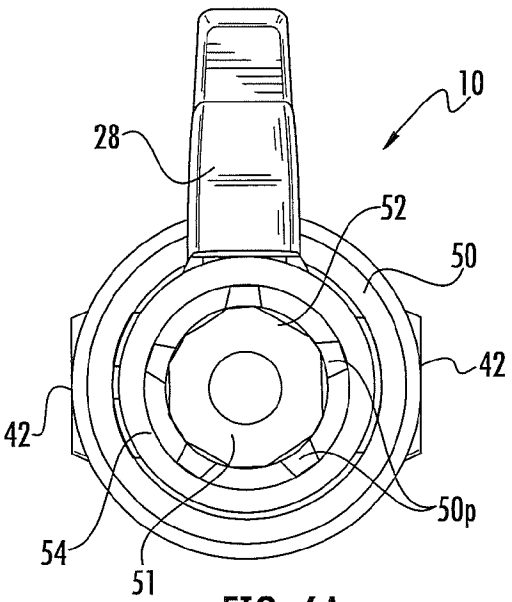
FIG. 6A is a rear end view of the tool shown in FIG. 1 according to some embodiments of the present invention.
Figure 7:
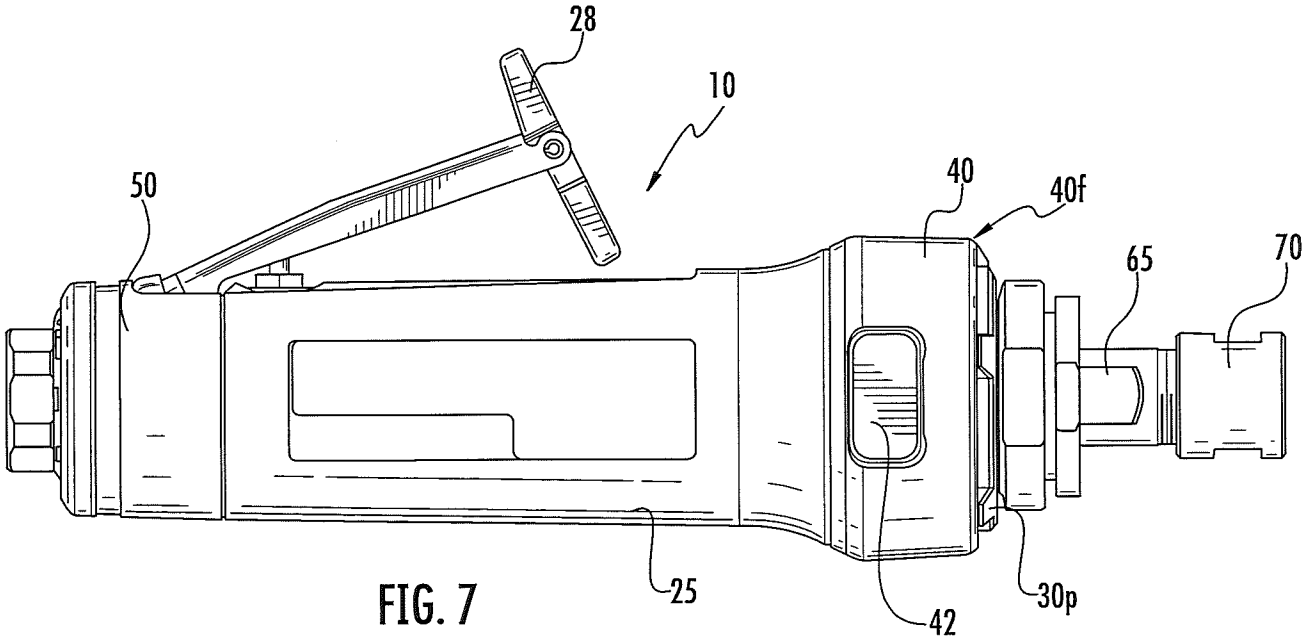
FIG. 7 is another side view of the tool shown in FIG. 1.

In some particular embodiments, for front and/or rear exhaust configurations, the post 30*p* styling can be substantially duplicated at the rear of the tool as rear posts 50*p* provided by the rear cap 50, 50' although the air exhaust pockets with the front exhaust configuration (FIG. 6A, 6B) can be non-functional. Indeed, the "pockets" 50*p* may be faux pockets that are not open and hence the housing 30 is not visible from this end in a front exhaust version. FIGS. 6A and 6B illustrates that the respective rear cap 50 can have a plurality of radially extending composite posts 50*p* that are circumferentially spaced apart and have a substantially similar configuration as the metallic front posts 30*p*.

As noted above, in some embodiments, the sleeve 20 can include three components, a front cap 40, 40', a center grip 25 and a rear cap 50, 50'. The center grip center portion 25 of the sleeve 20 can be substantially cylindrical and can have a substantially constant wall thickness. The front cap 40, 40' can have a thickness that is greater than that of the center grip portion 25 but may taper to a thinner size at a forward edge 40*f* at the interface 30*i* with the posts 30*p* as shown in FIG. 4. It is understood, however, that the tool 10, 10' can include any number of outer sleeve 20 components and configurations, and each is typically of the same material but may be constructed of other materials and may comprise any number of pieces, including one integrally-formed monolithic unitary piece, without departing from the scope of this invention.

As noted above, the tool 10 can be configured as either front or rear exhaust configurations (FIG. 1, FIG. 8) by changing several components. The center grip portion 25 can be used for both front and rear air exhaust power tool configurations. For a front exhaust configuration (e.g., FIG. 1), the front cap 40 can have a substantially constant inner diameter that is configured to contact only the front posts 30*p* and allow the gap spaces 30*s* to define pressurized air exhaust paths 33. The corresponding rear end cap 50 can have closed surfaces 50*c* (FIG. 6B) rather than open gap spaces 50*s* (FIG. 12) between composite posts 50*p*. For a rear air exhaust configuration (FIG. 8), the front cap 40' can be configured with inwardly extending segments 44 (FIG. 10) that close the spaces 30*g* between adjacent posts and inhibit or reduce pressurized air exhaust via the gap spaces 30*g*. The corresponding rear cap 50' can have open gap spaces 50*s* between adjacent posts 50*p* (FIG. 12).

Figure 10:
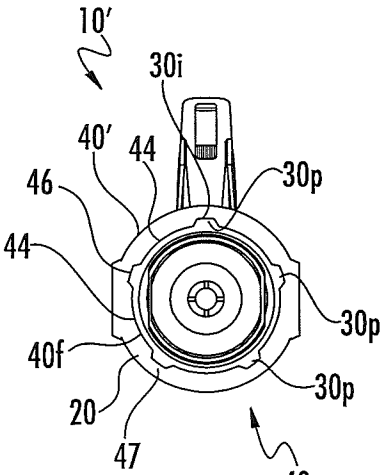
FIG. 10 is a front end view of the tool shown in FIG. 8.

Turning now to FIGS. 8-13, the rear exhaust version of the tool 10' can have the same internal components, e.g., motor assembly 60*a* and ball valve as discussed above. However, the front and rear end caps 40', 50' have a different configuration as noted above. As shown, the front end cap 40' defines a closed interface 30*i* for the housing 30 and housing posts 30*p*. As noted above, the front posts 30*p* can optionally be reduced in height relative to the front exhaust version. The forward portion of the (composite) outer front cap 40' can have a curvilinear profile (looking from the front, end view) that has alternating axial lengths about its forwardmost inner perimeter, e.g., longer where the cap 40' contacts or resides proximate to and faces the outer wall of the housing and a bit shorter where the cap contacts or resides proximate to and faces the free end of the posts. Thus, the cap 40' can have a series of stepped segments about the perimeter that contact the housing thereat to define a substantially closed interface 30*i*. Stated differently, as shown in FIG. 8, the sleeve front cap 40' has a front edge 40*e* with a curvilinear inner perimeter profile that has a circumferentially repeating pattern of an arc segment 44 that transitions to a thinner groove segment 46 (FIG. 10). The groove segment 46 has a recess sized to correspond to the height of a post 30*p*.

The forward portion of the (composite) outer sleeve front cap 40, 40' can also act to index the outer sleeve 20 with the internal housing 30, allowing for ease of manufacture. No muffling material is required at ridge 43 (unlike that shown in FIG. 4).

Figure 12:
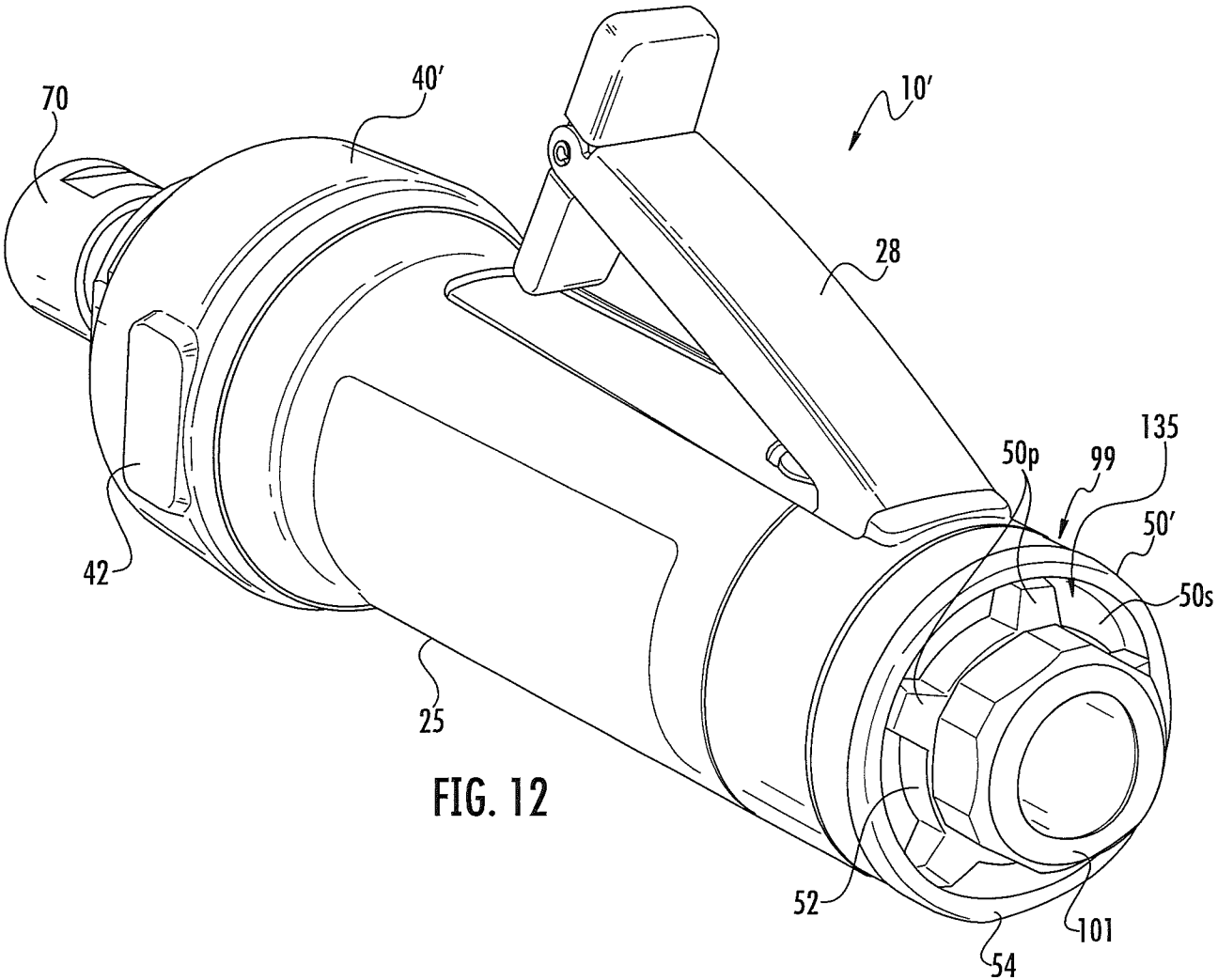
FIG. 12 is a rear side perspective view of the tool shown in FIG. 8 according to some embodiments of the present invention.

Referring to FIGS. 11 and 12 the rear cap 50' has exhaust ports 50*s* and the internal housing 30 is on the other side of the muffling material 135 (without which the housing could be seen through the spaces 50*s*). The inlet screen 66 can also be seen from this view (FIG. 11). The rear cap 50' has radially extending, circumferentially spaced apart composite posts 50*p* that have gap spaces 50*s* therebetween to define air exhaust ports. As shown, the posts 50*p* can be vertically oriented (for a horizontal grinder or sander). The rear cap can have an open center 51 space bounded by a circular segment 52 that merges into the radially extending posts 50*p* and outer end 50*e* of the posts 50*p* merge into an outer circular segment 54 that is larger than the inner circular segment 52. Muffling material 135 can be positioned between the rear end of the internal housing 30 and the exhaust posts 50*p*.

Figure 9:
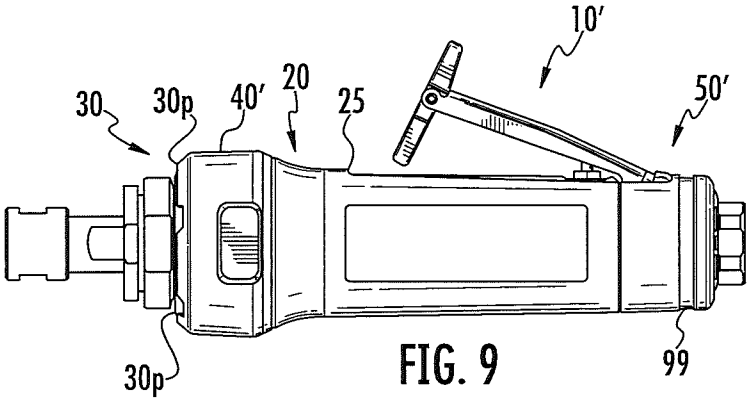
FIG. 9 is a side view of the tool shown in FIG. 8.

FIGS. 9 and 12 shows that the end cap 50' can include a circumferential groove 99 that can facilitate a piped-away exhaust feature.

Figure 13:
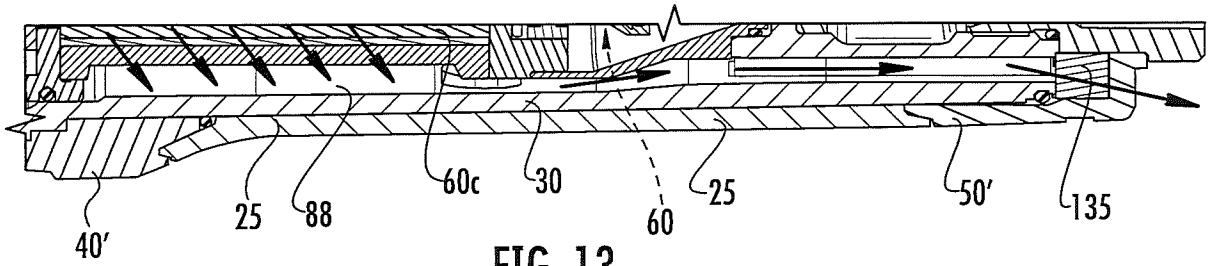
FIG. 13 is a top view of a portion of a section of the tool shown in FIG. 8 according to some embodiments of the present invention.

FIG. 13 illustrates air exhaust paths in the rear exhaust configuration. As discussed above with respect to FIG. 4, the inner wall of the housing 30 and external wall of the cylinder 60 can define an elongate pocket or free space 88 therebeween that extends over substantially an entire length of the cylinder 60*c* inside the housing 30 that accommodates an air volume of exhaust expelled or exhausted from the motor 60 during operation. A front portion of the tool can include a plurality of relatively large air passages 90 that fluidly connect the annular elongate volume 88 to annular exhaust chamber that resides between the sleeve 20 and housing 30. In the rear exhaust version shown, exhaust air is directed out through the post gap spaces 50*s*, typically first through the muffling material 135. The tool 10' can include air passages 90 as described above, e.g., circumferentially spaced apart about the cylinder 60*c*. Air surrounds the motor assembly 60*a*, flows rearward through muffler 135 and out of too through the end cap (e.g., rear exhaust diffuser) 50'.

Figure 16:
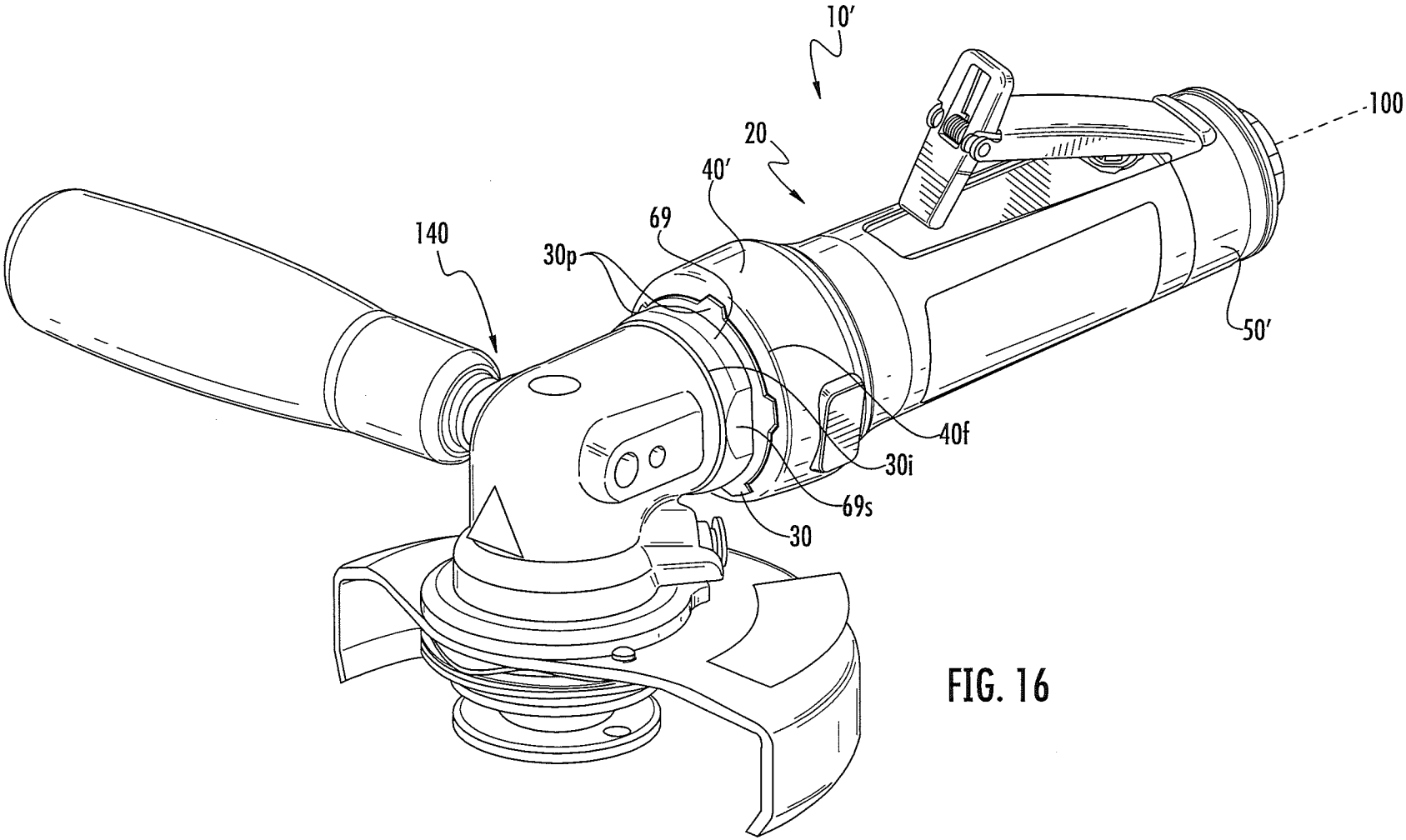
FIG. 16 is a front perspective view of the tool shown in FIG. 8 with an angle head according to embodiments of the present invention.

FIG. 16 illustrates a tool 10 with a configuration similar to FIG. 8 and with the front end of the tool having an angle head 140 that is attached to the composite sleeve 20 forward of the front cap 40' and with the metal motor housing according to embodiments of the present invention.

Figure 14A:
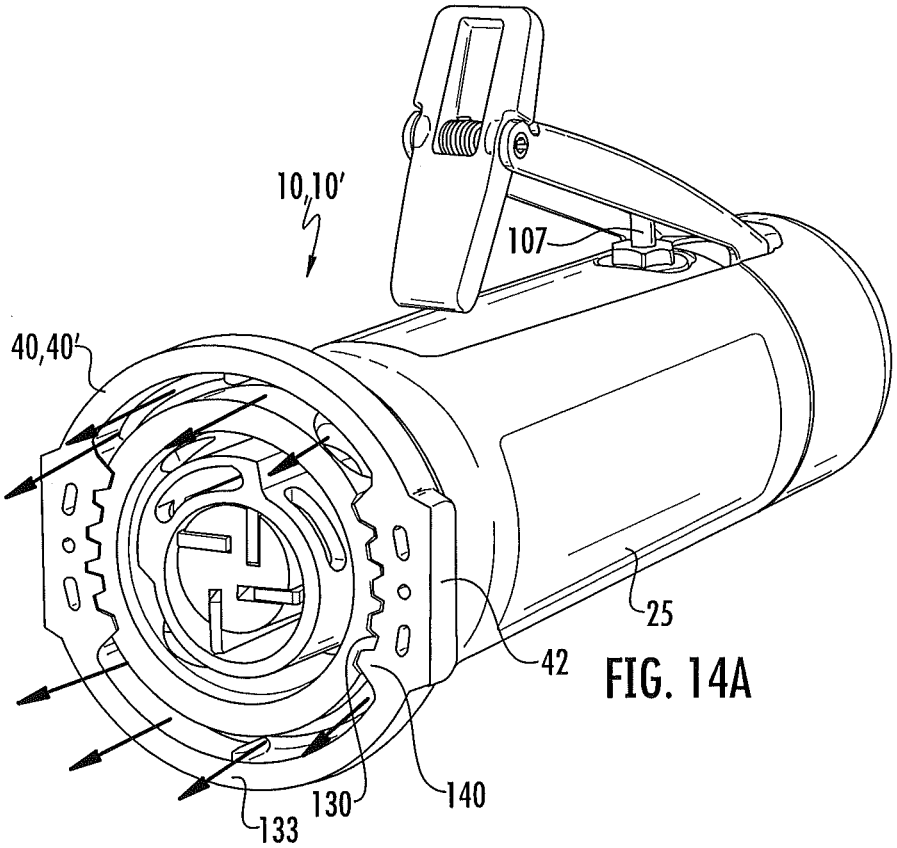
FIG. 14A is an enlarged front end partial transverse section view illustrating interlocking ribs (looking from the front end of the tool) according to some embodiments of the present invention.
Figure 14B:
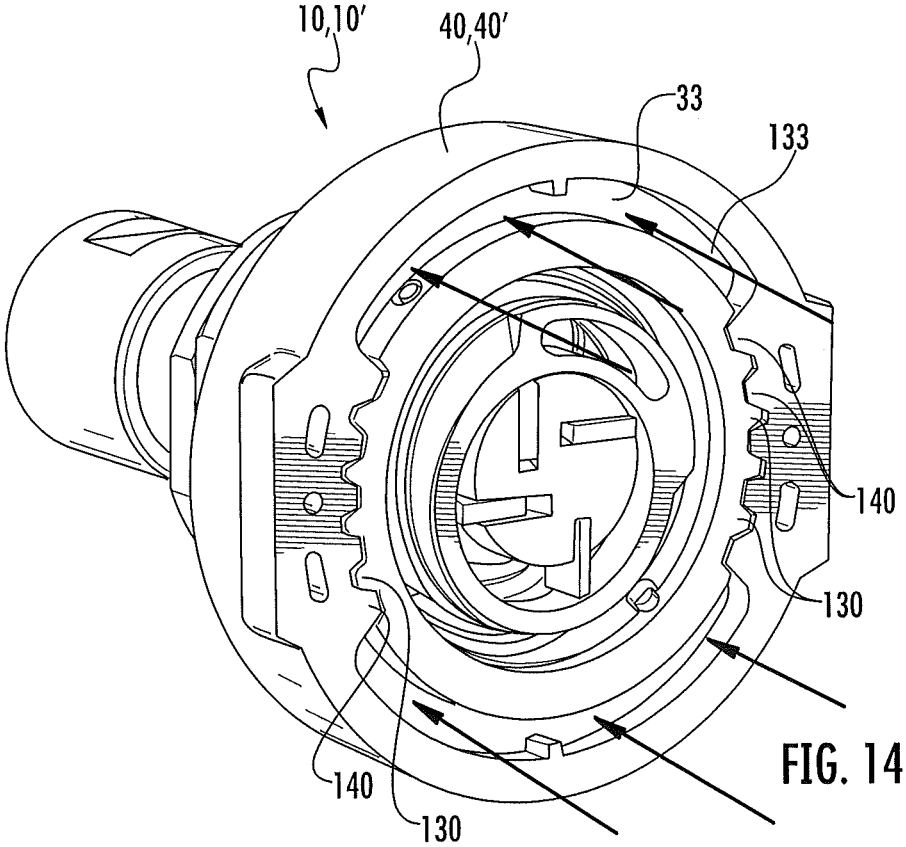
FIG. 14B is an enlarged section view of a forward end of the sectioned front part of the tool not shown in FIG. 14A (looking forward from the back) according to some embodiments of the present invention.
Figure 15A:
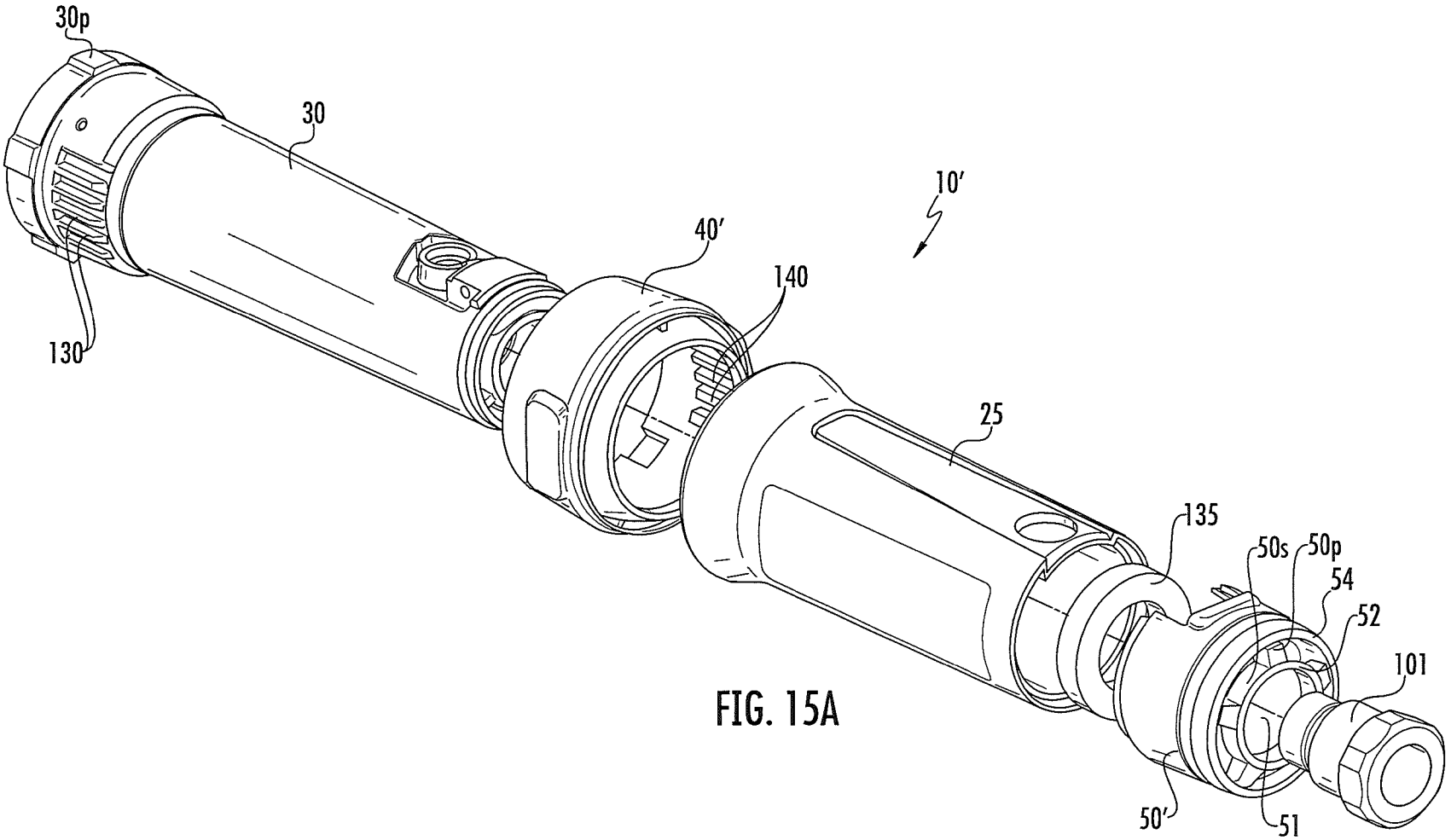
FIGS. 15A-15F are side perspective views of a sequence of assembly operations that can be used to assemble tools according to embodiments of the present invention.

FIGS. 14A, 14B and 15A illustrate that the housing 30 can include ribs 130 on an outer wall thereof at a front end portion of the housing 30 that slidably engage ribs 140 on an internal surface of the front cap 40, 40' when assembled. The ribs 130, 140 can be a plurality of longitudinally extending cooperating ribs that mesh or engage when assembled to inhibit rotation of the housing (such as when torque is applied to the inlet bushing 101). The flat(s) 42 can be used to help hold the tool 10, 10' in a vise for servicing.

As shown, the ribs 130, 140 can include at least two sets of circumferentially spaced apart, longitudinally extending ribs. The sets of ribs 130, 140 can be arranged so that they are diametrically opposed. Each set can have between about 2-20 ribs or even more ribs, such as between about 4-10, including about 4, about 5, about 6, about 7, about 8, about 9 and about 10, shown as 4-5. The ribs 130 and/or 140 can extend longitudinally a desired distance, typically between about 1-6 inches, and more typically between about 0.25 inches to about 1 inch. The shorter lengths may be particularly suitable when a discrete relatively short end cap 40, 40' (which can be between about 0.5-1.5 inches long) is used as part of the sleeve 20. Longer ribs may also be used. Also, the ribs 130 and/or 140 can be discontinuous on the housing or the sleeve (now shown).

The ribs 130 can reside a distance back from the posts 30*p* on the housing 30 and can reside at a back end of the front cap 40, 40' (FIG. 15A) and extend over about 30-80% of a length of the front cap 40, 40'. The ribs 130, 140 can occupy a subset of the circumference and may be spaced apart in sets as shown. However, the ribs 130, 140 may occupy greater than a major portion of the circumference and may extend about the entire circumference (not shown).

FIGS. 14A and 14B illustrate a front exhaust air schematic for purposes of discussion. The same cap and housing ribs 130, 140 can be used for rear exhaust versions, but the air travel for exhaust will be as described above for FIG. 13. For the front exhaust version 10, from the partial section view shown in FIG. 14A, the exhaust air 133 flows forward toward the muffler 35 (which resides downstream and is not in this view). FIG. 14B illustrate that exhaust air 133 flows around the interlocking ribs 130, 140 (above and below in the view shown) toward the front of the tool 10 which can cause different gap spaces 30*s* to have different exhaust volumes of air.

Figure 15B:
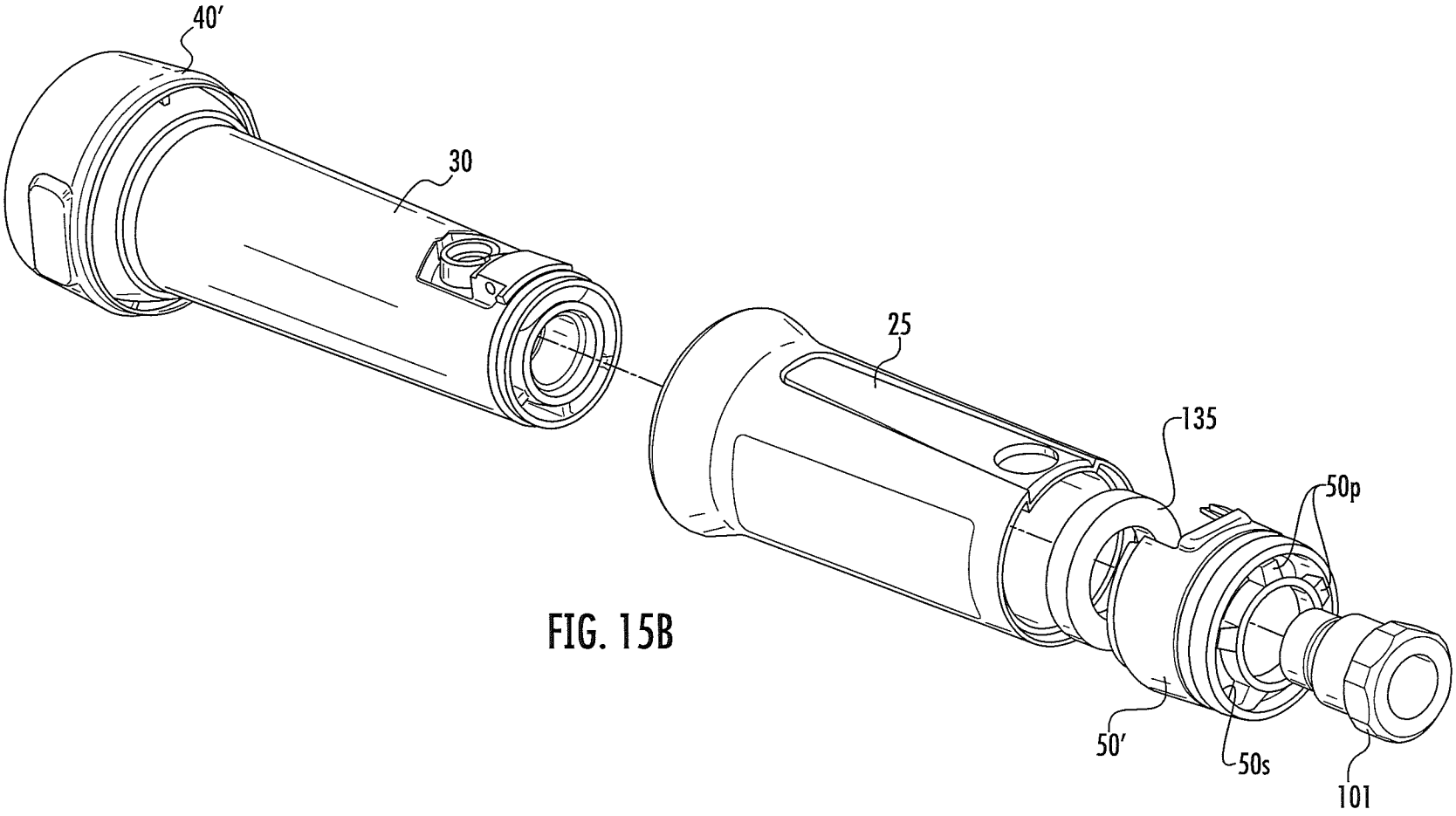
Figure 15C:
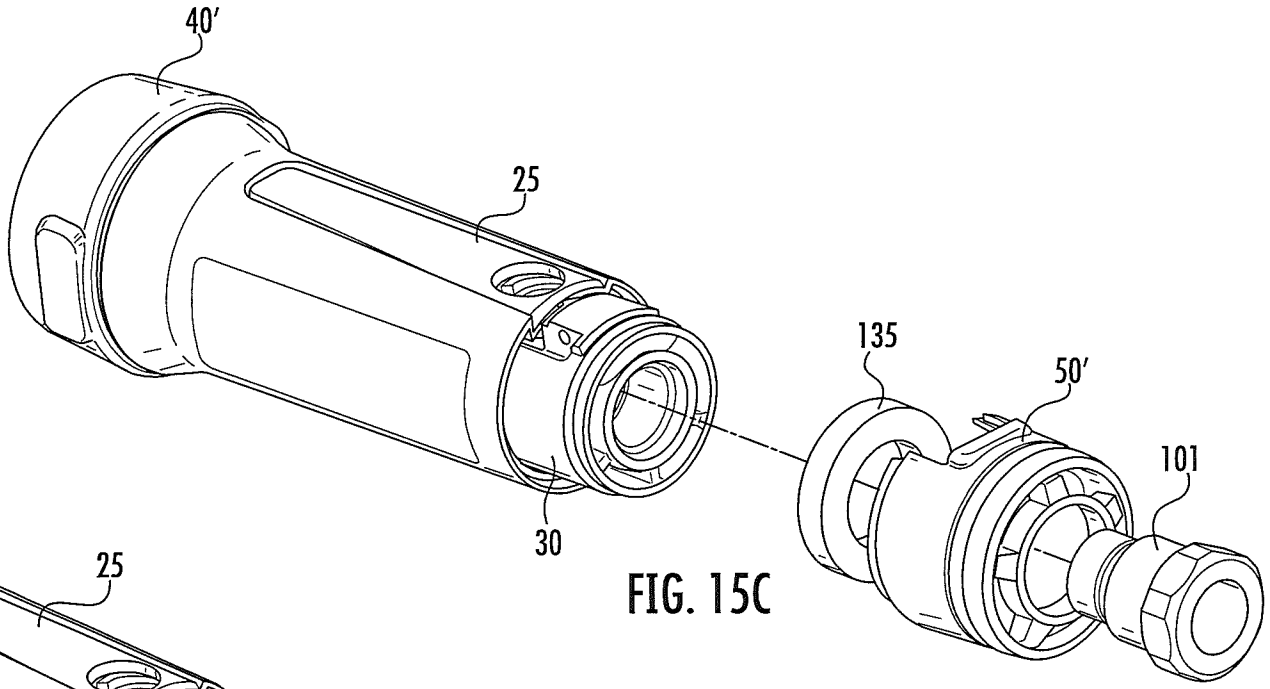
Figure 15D:
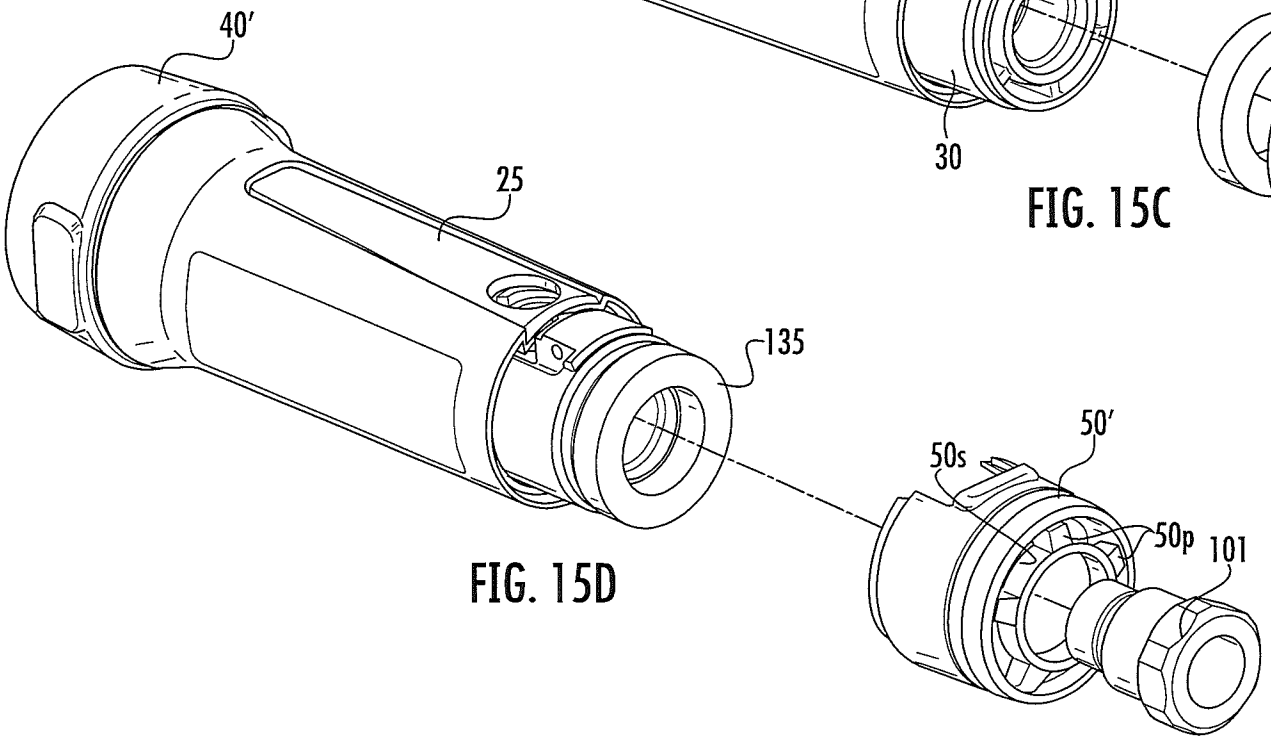
Figure 15E:
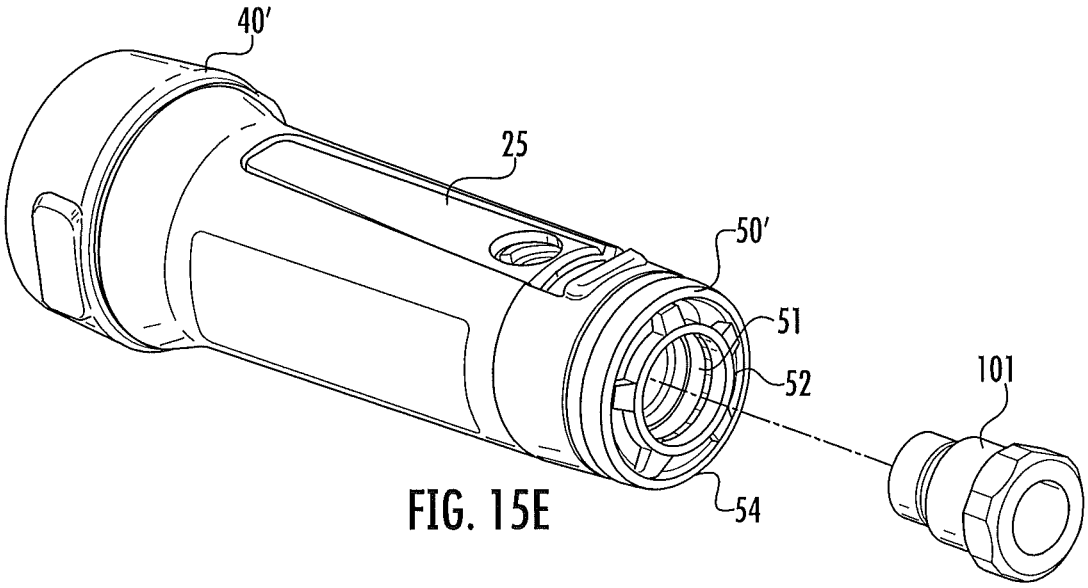
Figure 15F:
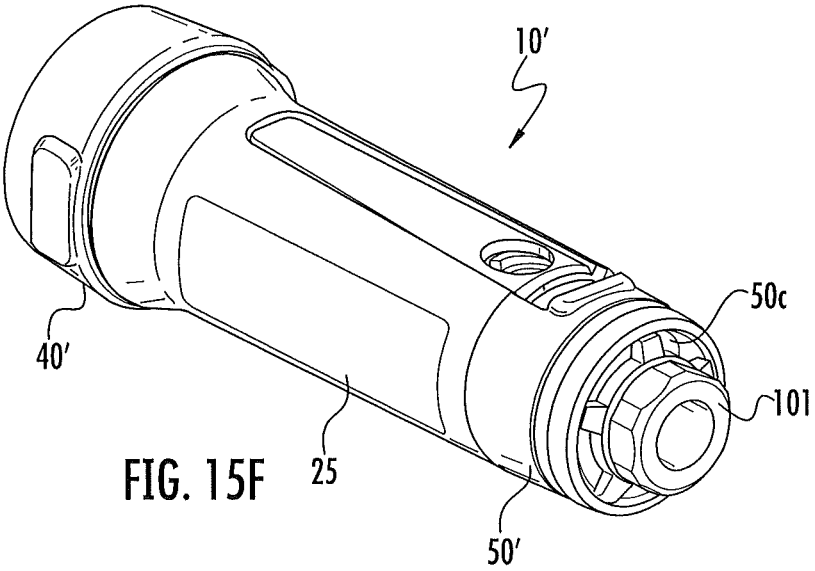

FIGS. 15A-15F illustrate an exemplary sequence that can be used to assemble the tools 10, 10' (shown with end caps 40', 50' for the rear exhaust version, but the sequence also applied to the front exhaust version). A front cap 40' with a plurality of circumferentially spaced apart, longitudinally extending internal ribs 140 can be aligned with the housing ribs 130 and slid from the back of the housing onto a front end portion of the housing 30. If a front exhaust version, the muffling material (muffler) can be positioned on the rear of the front posts prior to this step (not required in the rear exhaust version). FIG. 15B shows that the center grip 25 can then be slid on from the rear end of the housing 30. The throttle valve pin assembly can be inserted from the side. The ball 105 and spring 106, FIG. 4) can be axially inserted before the bushing 101. (not shown). As shown in FIG. 15D, the muffling material 135 can be positioned against the rear surface of the housing. FIG. 15E shows that the rear cap 50, 50' can then be slid onto the back of the housing 30. The inlet bushing 101 can be screwed into the metal housing 30 through the air inlet opening in the rear end cap 50', which presses the rear end cap forward and causes the sleeve sections to axially move together 40', 25, 50' (FIG. 15F) to interlock.

It is also contemplated the tool 10 can operate in both concurrent rear and front exhausts or the front and rear exhausts can be selectively employed on the same tool (thus the tool can have open exhaust ports on each end and may optionally be rotatable or accept a cap to close one set of open exhaust end ports).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, if used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A hand-held power tool, comprising:

an external elongate composite sleeve having a forward portion and a rearward portion and defining an axially extending cavity; and an internal metal housing having a substantially cylindrical body with a plurality of circumferentially spaced apart, longitudinally-extending, front metal posts that project radially outward a distance from the cylindrical body and are externally visible, the metal housing residing in the composite sleeve cavity; further comprising threads on an inner surface of the internal housing that threadably engage a clamp member on a forward end portion of the tool, the clamp member sized and configured to provide an externally accessible flat clamping surface.

2. The power tool of claim 1, wherein the tool is a front exhaust tool, wherein the front posts and sleeve cooperate to define a plurality of circumferentially spaced apart gap spaces, a respective gap space bounded by adjacent front posts, an outer surface of the cylindrical body and an inner surface of the forward portion of the sleeve to define front exhaust paths for the power tool.

3. The power tool of claim 1, wherein the tool is a rear exhaust tool, and wherein the sleeve forward portion has a front edge with a curvilinear perimeter profile that faces the internal housing and has a circumferentially repeating pattern of an arc segment that transitions to a groove segment, wherein the front posts extend out from the cylindrical body with a respective free outer end that resides adjacent an inner surface of the sleeve.

4. The power tool of claim 1, further comprising a vane motor that resides in the cavity of the internal housing a distance rearward of the front posts, wherein the sleeve comprises a front cap with a plurality of circumferentially spaced apart, longitudinally extending ribs on an inner surface thereof that matably engage at least two sets of circumferentially spaced apart longitudinally extending ribs on an external surface of the internal housing, wherein the internal housing ribs reside a distance behind the front posts.

5. A hand-held power tool, comprising:

an external elongate composite sleeve having a forward portion and a rearward portion and defining an axially extending cavity; and an internal metal housing having a substantially cylindrical body with a plurality of circumferentially spaced apart, longitudinally-extending, front metal posts that project radially outward a distance from the cylindrical body and are externally visible, the metal housing residing in the composite sleeve cavity;

wherein the sleeve comprises a front cap, a rear cap and a substantially cylindrical elongate center grip portion, and wherein the rear cap comprises a plurality of circumferentially spaced apart composite rear posts that radially extend about an open center aperture.

6. A hand-held power tool, comprising:

an external elongate composite sleeve having a forward portion and a rearward portion and defining an axially extending cavity; and an internal metal housing having a substantially cylindrical body with a plurality of circumferentially spaced apart, longitudinally-extending, front metal posts that project radially outward a distance from the cylindrical body and are externally visible, the metal housing residing in the composite sleeve cavity;

wherein the tool is a rear exhaust tool, and wherein the sleeve comprises a front cap, a rear cap and an elongate center grip portion, wherein the rear cap comprises a plurality of radially extending, circumferentially spaced apart composite rear posts that have gap spaces therebetween to define air exhaust ports, and wherein the front cap has a configuration that closes gap spaces between the front posts.

7. The power tool of claim 6, wherein the power tool is a horizontal grinder or sander, and wherein the rear cap has an open center space bounded by a circular segment that merges into the radially extending rear posts, and wherein an outer end of the rear posts merge into an outer circular segment that is larger than the inner circular segment.

8. A hand-held power tool, comprising:

an external elongate composite sleeve having a forward portion and a rearward portion and defining an axially extending cavity; and an internal metal housing having a substantially cylindrical body with a plurality of circumferentially spaced apart, longitudinally-extending, front metal posts that project radially outward a distance from the cylindrical body and are externally visible, the metal housing residing in the composite sleeve cavity;

wherein the sleeve includes a front cap and a substantially cylindrical elongate grip portion, wherein the front cap has a substantially constant diameter or a tapered outer profile with a front end thereof that merges into a thicker rearwardly extending portion with an inner surface segment that extends radially inward a stepped distance and defines a muffling material stop, then tapers inward to a thinner portion that resides under a leading edge of the center grip portion.

9. A hand-held power tool, comprising:

an external elongate composite sleeve having a forward portion and a rearward portion and defining an axially extending cavity; and an internal metal housing having a substantially cylindrical body with a plurality of circumferentially spaced apart, longitudinally-extending, front metal posts that project radially outward a distance from the cylindrical body and are externally visible, the metal housing residing in the composite sleeve cavity;

wherein the sleeve includes a front cap that abuts a substantially cylindrical elongate grip portion, wherein a forward edge portion of the cap abuts or is closely spaced to the front posts and defines air exhaust ports over the gap spaces, the tool further comprising a vane air motor residing in a cavity of the internal metal housing, wherein the internal housing has a plurality of circumferentially spaced apart air passages on a forward end portion thereof that allow air from the vane motor to travel to an annular exhaust chamber residing behind the posts, the annular exhaust air chamber defined by an outer wall of the internal housing and an inner wall of the front end cap.

10. The power tool of claim 1, wherein the plurality of front posts is at least five.

11. The power tool of claim 1, wherein the plurality of front posts is five, wherein the front posts are equally circumferentially spaced-apart, and wherein the front posts are tapered with narrower ends facing the sleeve.

12. A hand-held power tool, comprising:

an external elongate composite sleeve having a forward portion and a rearward portion and defining an axially extending cavity; and an internal metal housing having a substantially cylindrical body with a plurality of circumferentially spaced apart, longitudinally-extending, front metal posts that project radially outward a distance from the cylindrical body and are externally visible, the metal housing residing in the composite sleeve cavity;

wherein the internal metal housing encases a cylinder with an air vane motor, and wherein the composite sleeve has an elongate center grip portion, a front cap abutting a front end of the center grip portion and a rear cap abutting a rear end of the center grip portion, wherein the center grip portion is used for both front and rear air exhaust power tool configurations, and wherein, for a front exhaust configuration, the front cap is configured to allow the gap spaces to define pressurized air exhaust paths, and wherein for the rear air exhaust configuration, the front cap is configured with inwardly extending segments that close the gap spaces.

13. The power tool of claim 12, wherein the rear cap has a plurality of radially extending composite posts that are circumferentially spaced apart and have a substantially similar configuration as the front posts.

14. An internal housing for a hand-held industrial power tool, comprising:

a die cast metal housing having a substantially cylindrical body;

a plurality of circumferentially spaced apart, longitudinally-extending, front metal posts on a forward end of the metal housing substantially cylindrical body that project radially outward with a free end;

a plurality of longitudinally extending ribs on the metal housing that reside a distance spaced apart from and behind the front posts on a forward end portion thereof; and a plurality of circumferentially spaced apart air exhaust passages that extend radially outward from an inner surface to an outer surface of the metal housing cylindrical body behind the front posts on the forward end portion thereof.

15. The housing of claim 14, wherein the plurality of longitudinally extending ribs include first and second sets of circumferentially spaced apart ribs, wherein the plurality of front posts is five, wherein the front posts are tapered with the free end being more narrow, and wherein in operative position, are adapted to reside closely spaced to or abut a composite outer sleeve.

16. A method of assembling a hand-held power tool, comprising:

providing a substantially cylindrical metal housing having opposing front and rear ends, wherein the front end comprises a plurality of circumferentially spaced apart, longitudinally-extending front metal posts that project radially outward from the cylindrical body in a direction that is substantially orthogonal to a long axis of the metal housing;

providing a composite outer sleeve having a front cap, end cap and elongate substantially cylindrical center grip portion; and assembling the front cap, center grip and rear cap of the composite outer sleeve to the metal housing so that the metal housing resides in the composite sleeve with the front posts closely spaced to or abutting an inner surface of the front cap of sleeve.

17. The method of claim 16, wherein the plurality of front posts is five, and wherein the five front posts are substantially equally circumferentially spaced-apart posts, and wherein the front posts are tapered with narrower free ends abutting or being closely spaced to the front cap of the sleeve.

18. The method of claim 16, wherein the assembling step comprises:

assembling either a first set or differently configured second set of front and rear end caps to the metal housing, depending on whether the tool is a front air or rear air exhaust tool, wherein the front cap of the second set of caps for the rear exhaust tool closes off gap spaces between the front posts while the front cap in the first set of caps for the front exhaust tool cooperates with the front posts and metal housing to define front air exhaust pressurized ports for the power tool.

19. The method of claim 16, wherein the metal housing is aluminum or magnesium and has longitudinally extending ribs on an exterior surface thereof that reside rear of the front posts, and wherein the sleeve front cap has matable ribs, and wherein the assembly step comprises aligning the ribs and sliding the front cap onto the housing and defining annular exhaust chambers between an outer surface of the housing and an inner surface of the front cap adjacent to but behind the front posts.

* * * * *